US006139067A

United States Patent [19]

Roussey

[11] Patent Number: 6,139,067

[45] Date of Patent: Oct. 31, 2000

[54] DETACHABLE STAMP AND ENVELOPE

[76] Inventor: Roger Roussey, 82, boulevard Téllène, 13007 Marseille, France

[21] Appl. No.: 09/117,915

[22] PCT Filed: Feb. 20, 1997

[86] PCT No.: PCT/FR97/00318

§ 371 Date: Aug. 10, 1998

§ 102(e) Date: Aug. 10, 1998

[87] PCT Pub. No.: WO97/31355

PCT Pub. Date: Aug. 28, 1997

[30] Foreign Application Priority Data

Feb. 23, 1996 [FR] France ..... 96 02516

[51] Int. Cl.[7] ..... B42D 27/00; B42D 15/00

[52] U.S. Cl. ..... 283/116; 283/901; 283/71; 229/70

[58] Field of Search ..... 229/70; 283/71, 283/901, 116

[56] References Cited

U.S. PATENT DOCUMENTS

| | | | |
|---|---|---|---|
| 70,147 | 10/1867 | Steel | 283/71 |
| 101,604 | 4/1870 | Fletcher | 283/71 |
| 192,893 | 7/1877 | Beaumont | 283/71 |
| 194,212 | 8/1877 | Bierce | 281/71 |
| 2,153,504 | 4/1939 | Didier . | |
| 2,709,001 | 5/1955 | Stahl | 283/71 |
| 3,148,820 | 9/1964 | Robbins et al. | 229/37 |
| 3,368,741 | 2/1968 | Mercur . | |
| 3,545,669 | 12/1970 | Kinkade et al. | 229/73 |
| 3,822,901 | 7/1974 | Sedman | 283/6 |
| 4,033,611 | 7/1977 | Johnsen | 283/901 |
| 4,093,117 | 6/1978 | Morse | 229/70 |
| 4,278,199 | 7/1981 | Tanaka | 229/92.8 |
| 4,597,591 | 7/1986 | Gendron et al. | 283/1 |
| 4,762,271 | 8/1988 | Lewyt | 229/72 |
| 4,872,706 | 10/1989 | Brewen et al. | 283/71 |
| 4,900,597 | 2/1990 | Kurtin | 428/41 |
| 5,009,518 | 4/1991 | Faltynek | 229/70 |
| 5,011,069 | 4/1991 | Bowen et al. | 229/69 |
| 5,052,613 | 10/1991 | Lin | 229/71 |
| 5,248,082 | 9/1993 | Elminger | 229/303 |
| 5,344,190 | 9/1994 | Voltz | 283/71 |
| 5,863,073 | 1/1999 | Taskett | 283/58 |

*Primary Examiner*—A. L. Wellington
*Assistant Examiner*—Alisa Thurston
*Attorney, Agent, or Firm*—Ladas & Parry

[57] ABSTRACT

An envelope has one wall with a stamp integrated in the wall. The wall has a zone of least resistance which surrounds the stamp for removing the stamp from the wall. The stamp has a first, inner face with adhesive and/or graphic signs. In another embodiment, a second, outer face is marked with graphic signs and the second face has prominent parts of deformation of the stamp, and the first face has concave parts in register with the prominent parts for facilitating separation of the stamp from the envelope.

9 Claims, 2 Drawing Sheets

DETACHABLE STAMP AND ENVELOPE

The present invention relates to a detachable stamp, particularly a promotional stamp, and to an envelope comprising such a stamp.

The technical sector of the invention is that of the manufacture of postal stamps and envelopes.

BACKGROUND OF THE INVENTION

Patent Application FR 94 06356 (Jacques MEERSSEMAN) describes a promotional envelope for correspondence, of which the front face comprises a zone devoted to the address, a zone devoted to franking and a zone devoted to promotional advertizing, which is disposed to the left of the front face with respect to the address zone, or beneath the address zone and which may be completed by a promotional mark on the back of the envelope which may be enlarged by one or two surfaces equivalent to the rear surface of the envelope, which is (are) detachable from the envelope.

SUMMARY OF THE INVENTION

It is an object of the present invention to provide improved envelopes incorporating one or more stamps.

The invention consists in proposing an envelope (i.e. a flexible wrapping) for correspondence (i.e. for postal dispatch) made of paper or cardboard (or equivalent material) for sending in postal envelopes thin objects such as cards or letters, which is preferably of rectangular form, of which a so-called front wall comprises on its outer face a zone for writing the address and a zone for franking, which (front) wall comprises a stamp (or label) integrated in said wall, which wall comprises a zone (or part) of low resistance (i.e. whose mechanical strength is less than the average mechanical strength of the wall) which surrounds said stamp.

In other words, the solution to the problem raised consists in providing an envelope provided with a stamp (or label), which stamp is preferably of rectangular shape, of which one face comprises one or more graphic signs (of promotional and/or postal nature) which preferably comprises a regularly toothed border (or edge) which is integrated in one wall of the envelope and which comprises means for allowing and facilitating detachment thereof (for example by the presence of lines of least resistance) from the envelope, and consequently to facilitate conservation and storage by a stamp collector.

According to preferred embodiments, said zone (or line) of least resistance extends continuously around the stamp and is preferably constituted by a part of the wall of the envelope of which the thickness is smaller than the average thickness of the wall, which part of smaller thickness constitutes a hollow groove extending continuously around the stamp, which groove is preferably obtained by using a punch or cutter forming a pre-cutout around the stamp.

Alternately, said zone (or line) of least resistance extends discontinuously around the stamp, and is preferably constituted by a part of the wall of the envelope which is provided with a plurality of perforations made in the wall, which perforations are of small diameter (of the order of 1 millimeter or less than 1 millimeter) and are regularly spaced along a closed contour (or line) surrounding the stamp, which perforations are obtained by the action of one or more needles; said stamp may comprise parts in relief. The envelope may comprise a postal stamp integrated therein without relief, as well as a promotional stamp integrated therein in relief.

According to a preferred embodiment, the envelope comprises a detachable promotional stamp, said stamp being capable of being fixed or of adhering, for example of being stuck on a support; which stamp comprises a structure constituted by a thin sheet of paper provided with two faces, of which a first, inner face, is adhesive and of which a second, outer face, is marked with one or more graphic signs, which second face of the stamp may comprise prominent parts in relief; according to a preferred embodiment, said prominent parts are obtained by deformation of the structure of the stamp; said first face comprises concave or hollowed parts disposed in register with the parts in relief; the stamp and the envelope are preferably rectangular in shape; the envelope is provided with lines, zones or contours of least resistance facilitating detachment or separation of the stamp with respect to the envelope; said stamp is provided with teeth or indentations.

According to an embodiment, the first inner face comprises graphic signs which are concealed by a coating capable of disappearing under the effect of rubbing with a scratching object.

The invention also provides a pre-stamped envelope (or flexible wrapping of paper or cardboard, preferably rectangular in shape), for sending by post thin objects such as cards or letters, which comprises at least one easily detachable stamp integrated therewith.

The invention also provides an envelope for correspondence made of paper, which comprises a detachable zone of promotional marking, which comprises at least one removable stamp (of reduced size with respect to the dimensions of the envelope) which constitutes at least a part of said detachable zone of promotional marking, and which comprises a serrated edge and of which one face is marked with graphic signs.

In accordance with preferred embodiments of the envelope according to the invention:

- said stamp comprises prominent parts (in relief),
- the envelope and/or said stamp comprises at least one zone marked with one or more graphic signs which is coated or covered by a (removable) mask accessible solely by the interior of the envelope,
- the mask comprises a film of material adherent to the marked zone, which film is capable of being detached by scratching in order to disclose the graphic signs of the concealed marked zone,
- said mask is itself marked with one or more graphic signs and is preferably disposed opposite a window provided in a preferably front wall of the envelope,
- the concealed marked zone is located on the inner face of the front wall or the rear wall of the envelope, or is located at the back of a stamp,
- said stamp is disposed in the upper left-hand part of the front wall of the envelope and is integrated therein (the signs being printed on this wall).

The invention also consists in proposing a process for manufacturing an envelope in which:

- the blank of the envelope is cut out (developed and/or flat),
- one or more patterns or graphic signs constituting one or more franking and/or promotional stamps integrated therein are printed in a part of the blank intended to constitute a front wall of the envelope,
- said part of the blank is deformed, preferably by punching or partially cutting the wall, around said zone or zones containing the printed patterns, said stamping zone or zones containing said printed patterns are, as the case may be, deformed to form prominent parts and concave parts, by embossing or engraving for example, a part of the free edges of the blank is coated with adhesive means (glue or gum), the blank is folded to form the envelope.

The invention will be more readily understood on reading the following description with reference to the accompanying drawings, which illustrate without any limiting character preferred embodiments of the stamped envelope according to the invention.

BRIEF DESCRIPTION OF THE DRAWINGS

Unless indicated to the contrary, identical or similar elements in the different Figures bear the same reference numerals.

DETAILED DESCRIPTION OF THE DRAWINGS

Figure 1:
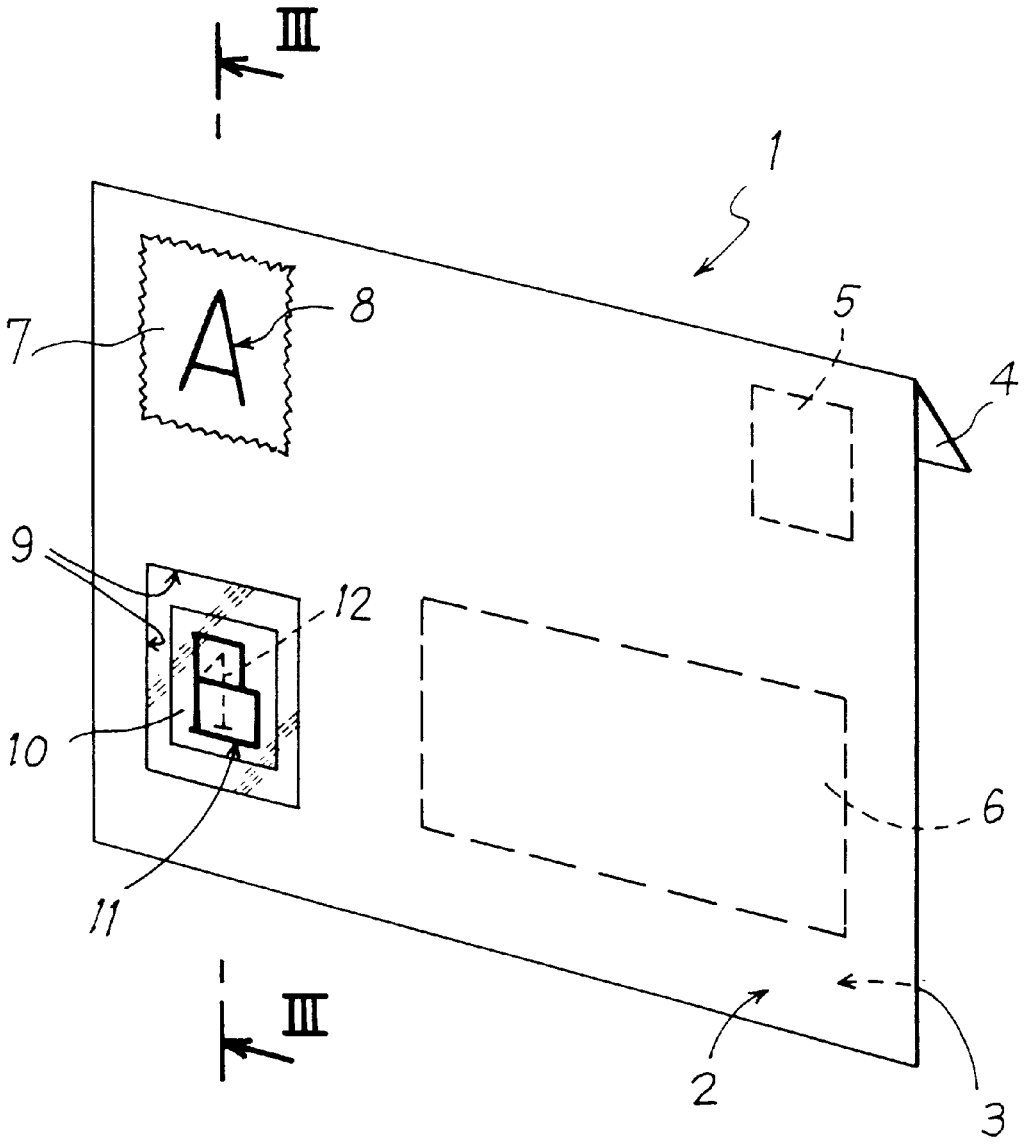
FIG. 1 schematically illustrates a simplified view in perspective of a stamped envelope according to the invention.

Referring now to the drawings, the envelope 1 is essentially constituted by two walls 2 and 3, namely a front wall 2 and a rear wall 3, and by a flap 4 for closing an opening allowing an object or objects to be introduced in the envelope.

The front wall 2 comprises an address zone 6 and a printed stamping zone 5 for franking.

The envelope further comprises a first promotional stamp 7 marked with at least a first sign 8 (by way of example, the letter "A" illustrated in FIG. 1).

The first stamp 7 is integrated in the front face of the front wall 2 of the envelope.

Figure 3:
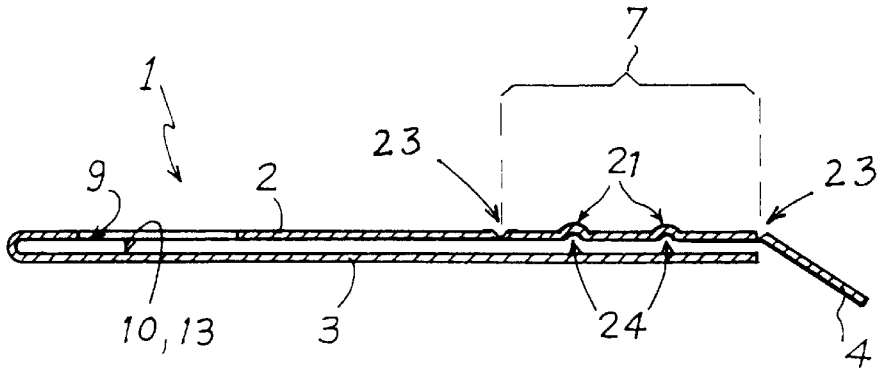
FIG. 3 is a view in section through a transverse plane of the envelope of FIG. 1, along III—III thereof.

The envelope illustrated in FIGS. 1 and 3 further comprises, in a lower lateral zone on the left-hand side, a window 9, i.e. a zone of the front wall 2 which is constituted by a translucent or transparent material, allowing a second promotional stamp 10 to be seen, incorporated in or stuck on the inner wall 13 of the rear face or wall 3 of the envelope 1.

The second stamp 10 comprises a second sign 11 (by way of example, the letter "B" as illustrated in FIG. 1), and may comprise an outer layer capable of being scratched and on which is marked said second sign, to constitute a mask concealing a third sign 12 (by way of example, the number "1" in the case of FIG. 1).

The first stamp 7 and/or the second stamp 10 preferably comprise parts 21 in relief and hollowed parts 24 disposed in register with the parts 21 in relief, which hollowed parts and parts in relief are obtained by deformation of the stamp and/or of a part of the corresponding wall of the envelope, when the stamp is integrated therein.

Figure 2:
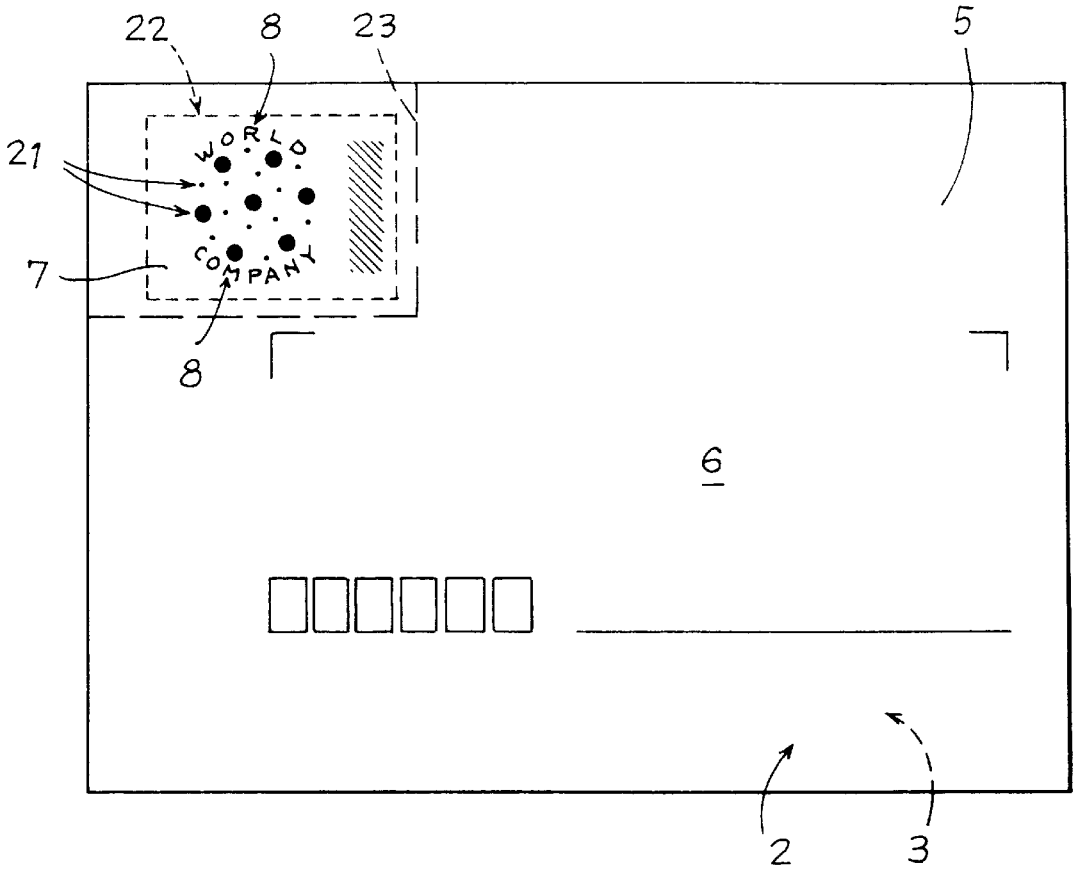
FIG. 2 is a view of the front wall of a second embodiment of a stamped envelope according to the invention.

As illustrated in FIG. 2, the stamp 7 comprising a complex graphic sign 8 constituting a logo or promotional design, is rectangular in shape, located in the upper left-hand part of the front wall 2 of the envelope, and comprises, on the one hand, parts 21 in relief, on the other hand, a serration 22 following a closed rectangular contour and also comprises a line or contour 23 of least resistance, facilitating cut-out or separation of the stamp 7 from the wall 2 of the envelope 1.

The relief of the stamp and/or of that part of the wall of the envelope constituting the stamp, may be obtained by deformation using a set of male and female dies which may be provided with means (such as punches and/or blades and/or needles) making it possible simultaneously to obtain the cutout of the serrations of the stamp and/or the perforations facilitating its pre-cutout; alternately, the parts in relief may be obtained by silk-screen printing.

Thanks to the small dimensions of the stamps (of which the length of each side does not exceed some centimeters) equipping the envelopes according to the invention and their detachable nature, these stamps may be easily detached and collected.

In addition, where the envelope is provided with a stamp concealed by a coating which may be destroyed by scratching with the aid possibly of a household object, the envelope may serve as support for games of chance.

The specific position of the promotional stamps and their parts in relief avoid any confusion with the postal stamps for franking; moreover, such stamps comprising parts in relief render cancellation thereof delicate, if not impossible.

What is claimed is:

1. In an envelope having one wall with a stamp integrated in said wall, the improvements wherein:

said wall comprises a zone of least resistance which surrounds said stamp for removing said stamp from said wall;

said stamp has a first, inner face with adhesive and a second, outer face marked with graphic signs; and said second face comprises prominent parts of deformation of said stamp, and said first face comprises concave parts in register with said prominent parts for facilitating separation of said stamp from said envelope.

2. In an envelope having one wall with a stamp integrated in said wall, the improvements wherein:

said wall comprises a zone of least resistance which surrounds said stamp for removing said stamp from said wall; and said stamp has a first, inner face with graphic signs which are concealed.

3. The envelope according to claim 1, wherein the inner face has graphic signs which are concealed.

4. The envelope according to claim 3, wherein the inner face is concealed by the envelope.

5. The envelope according to claim 2, wherein the inner face is concealed by the envelope.

6. The envelope according to claim 2, wherein the inner face is concealed by a coating which disappears by rubbing off.

7. The envelope according to claim 3, wherein the inner face is concealed by a coating which disappears by rubbing off.

8. The envelope according to claim 4, wherein the inner face is concealed by a coating which disappears by rubbing off.

9. The envelope according to claim 5, wherein the inner face is concealed by a coating which disappears by rubbing off.

* * * * *